United States Patent [19]

Barry

[11] Patent Number: 4,750,655

[45] Date of Patent: Jun. 14, 1988

[54] SELECTABLE SECUREMENT GUN HOLDING STRAP ASSEMBLY ON A HAND GUN HOLSTER

[76] Inventor: John C. Barry, 801 SE. 1st., P.O. Box 330, Winlock, Wash. 98596

[21] Appl. No.: 913,706

[22] Filed: Sep. 29, 1986

[51] Int. Cl.[4] ..... F41C 33/02

[52] U.S. Cl. ..... 224/243; 224/911

[58] Field of Search ..... 224/192, 243, 911, 238, 224/240, 243, 253, 901

[56] References Cited

U.S. PATENT DOCUMENTS

| | | | |
|---|---|---|---|
| 3,955,724 | 5/1976 | Perkins | 224/243 |
| 4,119,249 | 10/1978 | Hanson | 224/901 X |
| 4,270,680 | 6/1981 | Bianchi | 224/911 X |
| 4,312,466 | 1/1982 | Clark | 224/911 X |
| 4,378,082 | 3/1983 | Chica | 224/911 X |
| 4,480,776 | 11/1984 | Atkins | 224/238 X |
| 4,542,841 | 9/1985 | Bianchi et al. | 224/911 X |
| 4,580,707 | 4/1986 | Shoemaker | 224/911 X |

*Primary Examiner*—Henry J. Recla
*Assistant Examiner*—Robert M. Petrik
*Attorney, Agent, or Firm*—Roy E. Mattern, Jr.

[57] ABSTRACT

A hand gun holster substantially holds a hand gun for placement outside or inside of a person's belt and pants using a side or front belt loop. Depending on the selection of one of three ways of securing a three portion gun holding strap assembly, employing hook and loop fasteners: the hand gun is removed quickly by pulling the gun out of the holster, via a pull break step; the hand gun is removed less quickly from a normal securement, via a thumb break step; and the hand gun is removed from a maximum securement, via a double lock thumb break. The three portions of the gun holding strap assembly are: an anchor strap, secured at one end to one first side of the holster body, which is to be adjacent to a person, and covered on both sides with loop fastener components, which, via its free end is moved up and over gun hammer portions, during both the selected normal and maximum securement times, and is extended upright during the minimal securement times; a hammer strap secured at one end to the other second side of the holster body, and covered on an underside with hook fasteners, which, subsequently, is moved in the opposite direction to the direction of movement of the anchor strap, up and over the anchor strap and then secured thereto, during both the selected normal and maximum securement times; and a tab strap, having hook fasteners, and being reversely directed and secured to one end to the end of the hammer strap, to present an upstanding tab strap to be secured to the then upright anchor strap, during the minimal securement time, to stay as an unfastened upstanding tab strap, during the normal securement time, and to be a turned down and secured to the anchor strap during the maximum securement time.

8 Claims, 2 Drawing Sheets

SELECTABLE SECUREMENT GUN HOLDING STRAP ASSEMBLY ON A HAND GUN HOLSTER

BACKGROUND OF THE INVENTION

Hand gun holsters have been and still are made from leather. Also snap over straps and have been and are used to further retain a hand gun in a holster. Web materials have more recently been used, and quite recently hook and loop fastener components have been used to further retain a hand gun in a holster. Whatever materials have been used in various combinations, it is understood there has always been a limited range of choice in how securely a hand gun is held in a selected holster.

In reference to such choices, there are times when the hand gun must be: very well secured from unwanted removal for maximum security against its removal; reasonably well secured from removal for normal security against its removal; and less well secured from removal for less security against its removal, and conversely for its quick withdrawal. It is not known if previously there has been a hand gun holster which is easily, quickly, and optionally, adjusted, to secure a hand gun therein for optional periods of maximum, normal, or minimal security against the removal of the hand gun from the holster.

SUMMARY OF THE INVENTION

Hand guns are conveniently carried in a hand gun holster which is placed outside or inside of a person's belt and pants, using either a side or a front belt loop, through which a person's belt is threaded. At all times in such a selected carrying position, a person optionally selects one of three ways of removably securing a hand gun in its holster, by optionally arranging a three portion gun holding strap assembly, employing hook and loop fastener components.

When a hand gun must remain in the holster, yet be ready to be quickly removed, when a person directly grabs and lifts a hand gun up and out of a holster, then the three portion gun holding strap assembly is selectively arranged, so a pull break step is undertaken to quickly remove the hand gun. When a hand gun must remain in the holster, and be ready for a normal time removal, then the three portion gun holding strap assembly is selectively arranged, so a thumb break step is undertaken to remove the hand gun. When a hand gun must remain in the holster, and be very securely held against removal, then the three portion gun holding strap assembly is selectively arranged, so a double lock thumb break step must be undertaken to remove the hand gun from the holster.

The three portions of this gun holding strap assembly are: an anchor strap, a hammer strap, and a tab strap.

The anchor strap is secured at one of its ends, the anchored end, to one side of the body of the holster, and covered on both sides with loop fastener components. This anchor strap, via its free end, the movable end, is moved up and over the hammer portions of a hand gun, during both the optionally selected normal and maximum securement times, and this anchor strap is extended upright only during the minimum securement times.

The hammer strap is secured at one of its ends, the anchored end, to the other side of the body of the holster, and covered on an underside with hook fastener components. This hammer strap, via its free end, is subsequently moved in the opposite direction to the direction of movement of the anchor strap, up and over the anchor strap, and then secured to the anchor strap, during both the optionally selected normal and maximum securement times. Then during the minimum securement time, when the anchor strap is extended upright, this hammer strap is moved directly up and over the hammer portions of a hand gun, so its free end is adjacent to the anchor strap.

The tab strap having hook fastener components on one side, is reversely positioned and secured at one of its ends, the anchor end, to the free end of the hammer strap to create an upstanding tab to be secured to the then upright anchor strap, during the minimal securement time. This tab strap becomes an unfastened upstanding tab during the normal securement time. Then this tab strap is turned down and secured to the anchor strap near the secured end of the anchor strap, during the maximum securement time.

When the hand gun must be very quickly withdrawn from the holster, the three portion gun holding strap assembly is arranged in the minimum securement configuration. When a person grips the hand gun and pulls it out of the holster, the tab strap easily separates from the anchor strap clearing the way for the gun being pulled out of the holster.

When the hand gun must be withdrawn from the holster in a normal reasonably quick time period, the three portion gun holding strap assembly is arranged in the normal securement configuration. A person in gripping the hand gun uses her or his thumb, in an unlocking step, to push the tab strap up and away, which in turn separates the hammer strap up and away from the anchor strap. Then the hand gun is lifted clear of the holster.

When the hand gun must be withdrawn from the holster in a much longer time period, the three portion gun holding strap assembly is arranged in the maximum securement configuration. A person, using his or her thumb in a first unlocking step, first lifts the tab strap up and away from the anchor strap to reach the normal securement configuration. Then the person using his or her thumb in a second unlocking step lifts the hammer strap up and away from the anchor strap. Thereafter, the person indirectly lifts the anchor strap clear, as he or she pulls the hand gun up and out of the holster.

This maximum securement is especially desirable, when hand guns are being carried by law enforcement personnel and they are close by a suspect or a person under arrest, who may make an attempt to gain possession of the hand gun. Also this maximum securement is needed when anyone who is carrying a hand gun, is engaged in rescue work or similar activities, when a hand gun, if not securely held, could be unwantedly dropped out of the holster.

DRAWINGS

The arrangement and use of the selectable securement gun holding strap assembly on a hand gun holster, in a preferred embodiment, is illustrated in the drawings, wherein.

Figure 2:
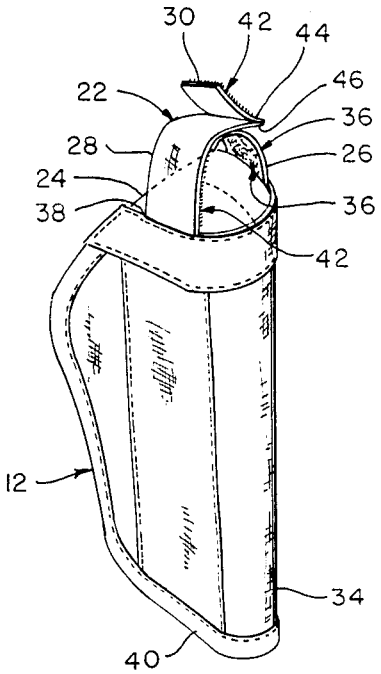
FIG. 2 is a perspective view of the hand gun holster having its selectable securement gun holding strap assembly, arranged in the normal securement configuration, as viewed from the side of the hand gun holster which is away from the side of a person, as shown in FIG. 1.
Figure 3:
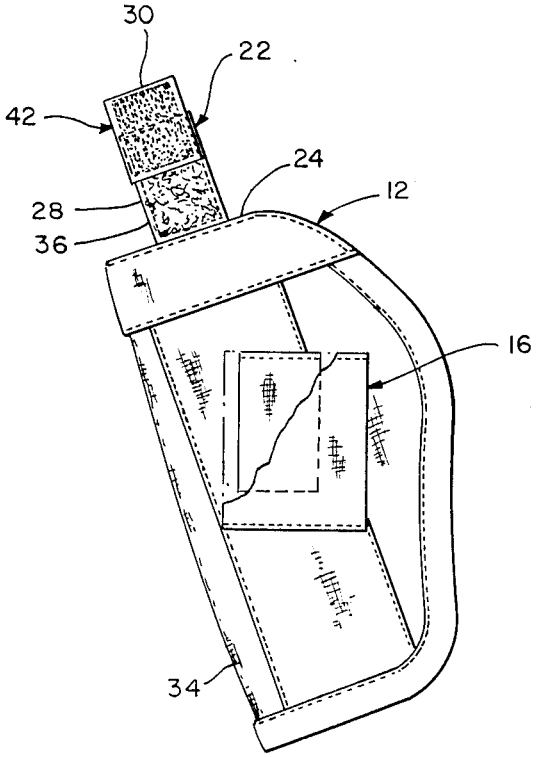
FIG. 3, is a side view of the hand gun holster and its selectable securement gun holding strap assembly, arranged in the normal securement configuration, as viewed from the side of the hand gun holster, which is adjacent to the side of a person, as shown in FIG. 1, indicating two belt sizes of an overall belt loop assembly.
Figure 4:
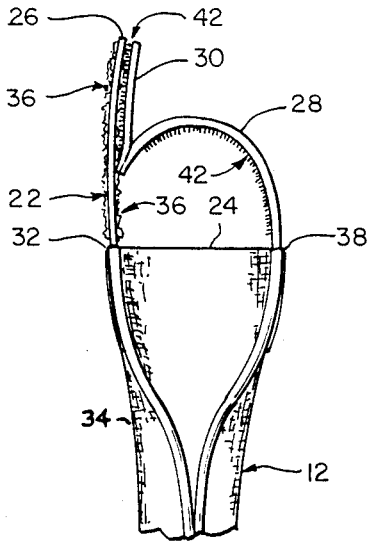
Figure 5:
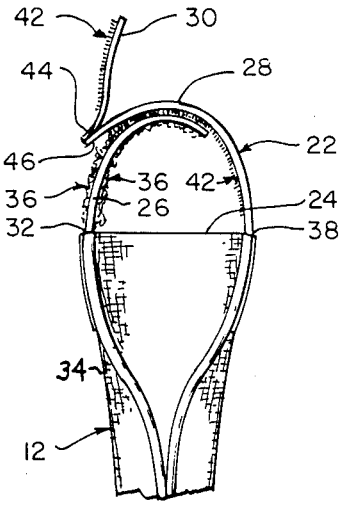
Figure 6:
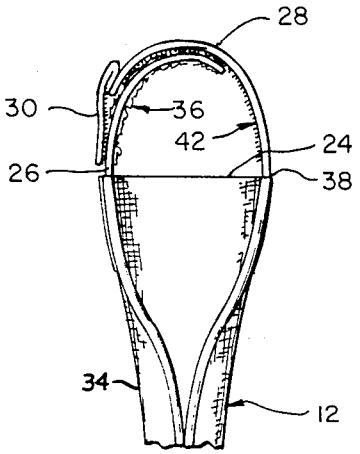
Figure 7:
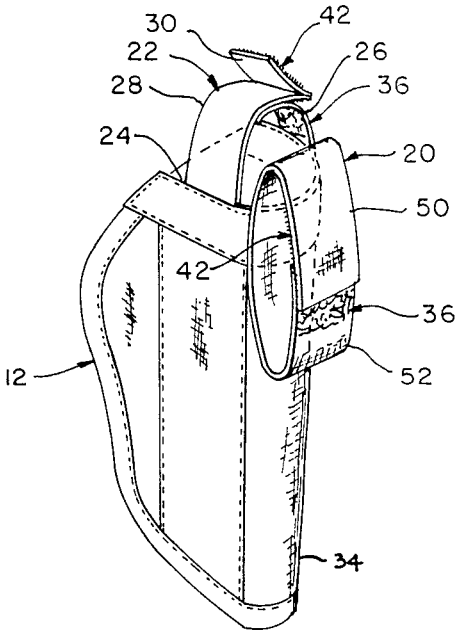

FIGS. 4, 5, and 6, are partial rear views of top portions of the hand gun holster to illustrate the selectable securement gun holding strap assembly, respectively arranged in FIG. 4, in the minimum securement configuration, referred to as the pull break arrangement, then in FIG. 5, in the normal securement configuration, referred to as the thumb break arrangement, and thereafter in FIG. 6, in the maximum security configuration, referred to as the double lock thumb break arrangement, indicating the three selective positionings of the anchor strap, the hammer strap, and the tab strap of the gun holding strap assembly; and FIG. 7 is a perspective view of the hand gun holster, which is similar to FIG. 2, but it is shown equipped with a two piece front belt loop, which is useful, when the hand gun in this holster is carried inside a person's pants, while supported by his or her belt.

DESCRIPTION OF PREFERRED EMBODIMENTS

Figure 1:
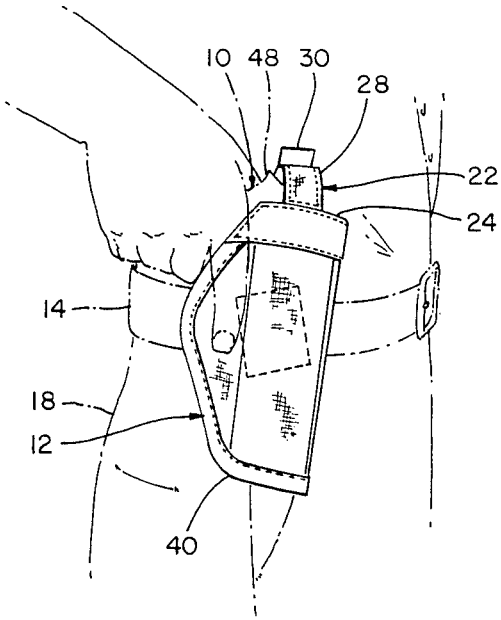
FIG. 1 is a partial side view of a person wearing the hand gun holster on the outside of his pants, as it is supported, via a belt loop, with his or her hand in place to commence lifting the hand gun up and out of the holster, when the hand gun is held in the normal securement pull break arrangement of the selectable securement of the three portion gun holding strap assembly.

When guns, such as hand guns 10 are carried in holders, such as a hand gun holster 12, shown in FIG. 1, they are carried at belt level, and positioned outside the belt 14, as shown in FIG. 1, using a side belt loop 16 of the holster 12. Also they are carried at belt level, but positioned inside one's pants 18 and belt 14 using a front belt loop 20 of the holster 12, as shown in FIG. 7.

Although a hand gun 10 will rest in such a holster 12 and be supported reasonably well, the preference has been and is to restrain the hand gun 12 from being lifted out of the holster 12, or dropping out of the holster 12. Such restraint is therefore, as illustrated in FIGS. 1 through 7, provided by a selectable securement gun holding strap assembly 22 secured to the top 24 of the holster 12.

This selectable securement gun holding strap assembly 22 has three portions: an anchor strap 26, a hammer strap 28, and a tab strap 30.

The anchor strap 26 is secured at one end 32 of its ends to the top 24 of the holster 12, on the side 34, considered the first side, of the holster 12, which is adjacent to the belt 14, and consequently adjacent to a person, as illustrated throughout the drawings. It may be covered on both sides with loop or hook fastener components, and as optionally selected in this embodiment, the anchor strap 26 is covered on both sides with loop fastener components 36.

The hammer strap 28 is secured at one end 38 of its ends to the top 24 of the holster 12, on the side 40, considered the second side, which is opposite the first side, of the holster, which is not adjacent to the belt 14, as illustrated throughout the drawings. It is covered on an underside with hook fastener components 42. These are selected, if the anchor strap 26 is covered with loop fastener components 36.

The tab strap 30 is reversely positioned and secured at one end 44 to the free end 46 of the hammer strap 28 to create an upstanding tab having hook fastener components 42 on the belt orientated side. These components 42 would be loop fastener components 36, if the hammer strap 28 were to have instead loop fastener components 36. The tab strap 30, in reference to being reversely positioned, after being sewn in place, extends back over the free end 46 of the hammer strap 28. The tab strap 30 does not continue on in the same direction as determined by the free end 46 of the hammer strap 28.

When the hand gun 10 must be kept in the holster 12, and yet be very quickly withdrawn from the holster 12, the selectable securement three portion gun holding strap assembly 22 is arranged in the minimum securement configuration, as illustrated in FIG. 4. The anchor strap 26 extends upwardly. The hammer strap 28 is raised up and over the hammer 48 of the hand gun 10. The tap strap 28, then exending upwardly, is secured to the upstanding anchor strap 26, via the hook fastener component 42 on the tab strap 28 and the loop fastener components 36 on the anchor strap 26.

When a person grips the hand gun 10 and pulls it out of the holster 12, the tab strap 30 relatively easily separates from the anchor strap 26. This clears the way for the hand gun 10 being pulled out of the gun holster 12.

When the hand gun 10 must be withdrawn from the holster in a normal reasonably quick time period, the selectable securement three portion gun holding strap assembly 22 is arranged in the normal securement configuration, as illustrated in FIGS. 1, 2, 3, 5 and 7. The anchor strap 26 first extends up and over the hammer 48 of the hand gun 10. Then the hammer strap 28, in the other direction, extends up and over the anchor strap 26, and consequently also up and over the hammer 48. It is then firmly secured to the anchor strap 26, as the hook fastener components 42 of the hammer strap 28 enter the loop fastner components 36 of the anchor strap 26. The tab strap 30 remains free and upstanding.

When a person grips the hand gun 10, his or her thumb is used to push the tab strap 30 farther up and away, which in turn separates the hammer strap 28 up and away from the anchor strap 26. Then the hand gun 10 is lifted clear of the holster.

When the hand gun 10 must be withdrawn from the gun holster 12 in a much longer time period, the selectable securement three portion gun holding strap assembly 22 is arranged in a maximum securement configuration, as illustrated in FIG. 6. The anchor strap 26 first extends up and over the hammer 48 of the hand gun 10. Then the hammer strap 28, in the other direction, extends up and over the anchor strap 26, and consequently also up and over the hammer 48. It is then firmly secured to the anchor strap 26, as the hook fastener components 42 of the hammer strap 28 enter the loop fastener components 36 of the anchor strap 26. The tab strap 30 is folded back and down and secured to the secured end of the anchor strap 26, as the hook fastener components 42 of the tab strap 30 enter the loop fastener components 36 of the anchor strap 26.

When a person grips the hand gun 10, his or her thumb is used in a first unlocking step, to lift the tap strap 30 up and away from the anchor strap 26 to reach the normal securement configuration. Then the person, in a second unlocking step, uses his or her thumb to lift the hammer strap 28 up and away from the anchor strap 26. Thereafter, the person indirectly lifts the anchor strap 26 clear, as he or she pulls the hand gun 10 up and out of the gun holster 12.

The maximum securement, as shown in FIG. 6, is desired by law enforcement personnel, when they expect to be very close by a suspect without drawing a gun 10, such as nearby a person under arrest. Any attempt by such a person under arrest to gain possession of a hand gun 10, so held, will be delayed enough so the suspect will not be successful in his or her attempt. Also such maximum securement is wanted when a person carrying the gun 10 is engaged in rescue work and the gun 10 must be kept in the gun holster 12.

The normal securement as shown in FIG. 5, probably will be the most used securement. Yet there will be times when law enforcement personnel will be closing in on a suspect, who may be armed, and if the hand gun 10 must still remain in the gun holster 12, then the minimum securement is utilized, as shown in FIG. 4.

In specific reference to the embodiment illustrated in FIGS. 1 through 7, the selectable securement gun holding strap assembly 22, is derived from the following starting materials and sizes.

The anchor strap 26 is made from a 7½" piece of 1" nylon webbing which has its cut edges singed, then is folded over and sewn along all edges. Thereafter it is sewn to one side of the gun holster 12, which is essentially made of nylon webbing. The hammer strap 28 is made from a 5½" piece of 1" webbing, which has its cut edges singed, then is folded over and sewn along all edges. Thereafter it is sewn to the other side of the gun holster 12. The tap strap 30 is reversely positioned and then sewn on the hammer strap 28 and thereby does not continue on in the same direction as determined by the free end 46 of the hammer strap 28. Preferably before these straps are sewn in place, their respective loop or hook fastener components are selectably placed on them to create the previously described securement concepts of these straps 26, 28 and 30.

The front belt loop 20 is also made of 1" nylon webbing. It is preferably made in one piece secured in its central length to the holster 12, with its ends adjustably folded against one another. These ends are so held adjustably together, as one end 50 has hook fastener components 42 secured to it, and the other end 52 has loop fastener components 36 secured to it. The front belt loop 20 is secured to holster portions which face in the same direction a person faces, who is wearing the holster.

As shown in FIG. 7, the selectable securement gun holding strap assembly 22 as used with the gun holster 12, permits a person to carry his or her gun 10 on the inside or outside, while supported on a belt 14. In both carying positions, the person selects the respective securement configuration, among minimum securement, normal securement, and maximum securement.

I claim:

1. A selectable securement gun holding strap assembly for a gun holster, comprising:

(a) an anchor strap, having two ends, adapted to be secured at one of these ends to one first side of the body of a gun holster, which is to be adjacent to a person, and covered on both sides with an alike grouping of loop and hook fastener components;

(b) a hammer strap, having two ends, adapted to be secured at one of these ends to the second other side of the body of a gun holster, and covered on an underside with an alike grouping of loop and hook fastener components, which are of opposite function to the loop and hook fastener components, which cover both sides of the anchor strap; and (c) a tab strap, having two ends, reversely positioned and secured at one end of these ends to a free end of the hammer strap, thereby extending back over the free end of the hammer strap, and covered on the outside with a like grouping of loop and hook fastener components, which are like the like grouping of loop and hook fastener components covering the underside of the hammer strap;

whereby these three straps of this assembly are selectively arranged, with respect to a gun in a holster, to provide, respectively: minimum securement, referred to as a pull break, when the tab strap and anchor strap are secured together, when a gun must be very quickly withdrawn from a holster; normal securement, referred to as thumb break, when the hammer strap and anchor strap are secured together, when a gun must be ready after a normal withdrawal time; and a maximum securement, referred to as a double lock thumb break, when the hammer strap and the anchor strap are secured together, and the tab strap is also secured to the anchor strap, when a gun must be withdrawn from the holster in a much longer time period.

2. A selectable securement gun holding strap assembly for a gun holster, as claimed in claim 1, wherein in the minimum securement configuration, the anchor strap is extended upright, the hammer strap is placed up and over a hammer of a gun, and the tab strap is secured to the upright extended anchor strap, whereby, when a person grips a hand gun and pulls it out of a holster, the tab strap easily separates from the anchor strap clearing the way for the gun being pulled out of the holster.

3. A selectable securement gun holding strap assembly for a gun holster, as claimed in claim 1, wherein in the normal securement configuration, the anchor strap is lifted up and over a hammer of a gun, the hammer strap is lifted up and over the anchor strap in the reverse direction, and then secured to the anchor strap, and the tab strap remains essentially upright, whereby, when a person grips a hand gun, he or she uses his or her thumb, in an unlocking step, to push the tab strap up and away, which in turn separates the hammer strap up and away from the anchor strap, and thereafter the hand gun is lifted clear of the holster.

4. A selectable securement gun holding strap assembly for a gun holster, as claimed in claim 1, wherein in the maximum securement configuration, the anchor strap is lifted up and over a hammer of a gun, the hammer strap is lifted up and over the anchor strap in the reverse direction, and then secured to the anchor strap, and the tab strap is folded back over itself, being turned down and secured to the anchor strap near the secured end of the anchor strap, whereby, when a person grips a hand gun, he or she uses his or her thumb in two unlocking steps, first in unlocking the tab strap from the anchor strap, and second in unlocking the hammer strap from the anchor strap.

5. A selectable securement gun holding strap assembly, as claimed in claim 1, comprising, in addition, a gun holster, with one end of the anchor strap being secured to one first side of the gun holster, and with one end of the hammer strap being secured to the other second side of the gun holster.

6. A selectable securement gun holding strap assembly and gun holster, as claimed in claim 5, wherein the gun holster has a side loop on the one first side of the body of the gun holster to receive a person's belt.

7. A selectable securement gun holding strap assembly and gun holster, as claimed in claim 5, wherein the gun holster has a front loop, secured to the holster portions which face in the same direction a person faces who is wearing the holster, to receive a person's belt.

8. A selectable securement gun holding strap assembly and gun holster, as claimed in claim 6, wherein the gun holster has a front loop, secured to the holster portions which face in the same direction a person faces who is wearing the holster, to receive a person's belt.

* * * * *